US008366230B2

(12) United States Patent
Taira et al.

(10) Patent No.: US 8,366,230 B2
(45) Date of Patent: Feb. 5, 2013

(54) INK JET PRINTING APPARATUS AND INK JET PRINTING METHOD

(75) Inventors: Hiroshi Taira, Inagi (JP); Kiichiro Takahashi, Yokohama (JP); Minoru Teshigawara, Saitama (JP); Tetsuya Edamura, Inagi (JP); Akiko Maru, Tokyo (JP); Yoshiaki Murayama, Tokyo (JP); Takatoshi Nakano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

(21) Appl. No.: 13/078,506

(22) Filed: Apr. 1, 2011

(65) Prior Publication Data

US 2011/0249049 A1 Oct. 13, 2011

(30) Foreign Application Priority Data

Apr. 7, 2010 (JP) ..... 2010-088654

(51) Int. Cl.
*B41J 29/38* (2006.01)

(52) U.S. Cl. ..... 347/16; 347/9; 347/101

(58) Field of Classification Search ..... 347/5, 9, 347/16, 19, 20, 37, 101, 104
See application file for complete search history.

(56) References Cited

U.S. PATENT DOCUMENTS

| | | | | |
|---|---|---|---|---|
| 6,511,143 | B1 * | 1/2003 | Ishikawa et al. | 347/9 |
| 7,651,194 | B2 | 1/2010 | Yazawa et al. | |
| 7,748,809 | B2 | 7/2010 | Takahashi et al. | |

FOREIGN PATENT DOCUMENTS

| | | | |
|---|---|---|---|
| JP | 2005-144808 | A | 6/2005 |
| JP | 2005-305811 | A | 11/2005 |
| JP | 2006-159483 | A | 6/2006 |
| JP | 2009-006676 | A | 1/2009 |

* cited by examiner

*Primary Examiner* — Juanita D Jackson
(74) *Attorney, Agent, or Firm* — Fitzpatrick, Cella, Harper & Scinto

(57) ABSTRACT

An ink jet printing apparatus is provided that can perform printing without degrading printing quality. In the present invention, correction for a head-to-sheet distance change is performed for both forward printing and backward printing during a multi-path printing operation.

5 Claims, 15 Drawing Sheets

| | |
|---|---|
| FIG.15A | |
| FIG.15B | |
| FIG.15C | |
| FIG.15D | |
| FIG.15E | |

INK JET PRINTING APPARATUS AND INK JET PRINTING METHOD

BACKGROUND OF THE INVENTION

1. Field of the Invention

The present invention relates to an inkjet printing apparatus and ink jet printing method equipped with a device that adjusts a drive timing independently for the forward movement of a print head and for the backward movement of the print head, and for individual printing areas.

2. Description of the Related Art

An ink jet type printing apparatus, (hereinafter referred to as an ink jet printing apparatus), prints by employing fluid inks and a print head that ejects ink droplets onto print media to form characters or images. Ink jet printing apparatuses perform high definition printing more easily than other printers and provide the additional advantages, such as high printing speeds, reduced operating noise and lower prices.

For image printing, an ink jet printing apparatus employs a print head to scan a print line on a sheet, a print medium, in a direction (the main scan direction) perpendicular to the direction in which the sheet is conveyed, and when one or a plurality of scans have been completed, the sheet is conveyed in a direction (the sub-scan direction) perpendicular to the main scan direction to the succeeding print line, and thereafter moves the print head along that print line. Then, according to the system that sequentially prints images on a print medium, when the print head travels one way (in the forward direction) and returns the other way (in the backward direction), printing (hereinafter, also called two-way printing) is performed in both directions to increase the printing speed.

However, unless the drive timings for the forward and backward movements of the print head are adjusted, an optimal image will not be printed. That is, printing positions on the print medium may be displaced between the forward movement and the backward movement of the print head, and in this case, density unevenness would appear in a printed image and cause deterioration of the image quality.

Therefore, for forward and backward printing, the print positions of the print head should be adjusted, or specifically, adjustment of the drive timing for the print head is required.

The print head is located opposite a support member (platen) that supports a print medium, such as paper or film, from the back, and in order to avoid any interference by the print medium supported by the platen, a predetermined gap (head-to-sheet distance) is defined between the print head and the surface of the print medium. When electrothermal transducing elements are driven based on print data that has been entered, the print head ejects ink droplets through ejection ports, and these ink droplets travel across the gap formed between the print head and the print medium and land on the surface of the print medium. In this manner, image printing can be performed.

When such an ink jet printing apparatus is employed to perform high-quality image printing, it is preferable that an appropriate setting be selected as a head-to-sheet distance (gap) between the print head and a print medium. Specifically, when the head-to-sheet distance between the print head and the print medium is too small, the possibility is increased that the print head will touch the print medium, and that either more ink than necessary will be attached to the print medium, or a print medium movement failure will occur. And when the head-to-sheet distance is too great, there is a possibility that the locations where ink droplets actually land will be displaced, from anticipated reference positions on the print medium, and accurate image printing will sometimes not be performed.

As a conventional well known countermeasure for this problem, an adjustment mechanism that adjusts the head-to-sheet distance between a print head and a platen is provided, so that the print head can always be adjusted to an appropriate position in accordance with the thickness of a print medium. Further, a printing mode is changed, i.e., for the previous printing mode, the top and bottom sides and right and left sides of a print medium were defined as non-printing areas (hereinafter also called "margined printing"), but these areas are defined as fully printable (hereinafter also called "marginless printing").

For image printing performed by the ink jet printing apparatus, a print medium is sandwiched by two or more conveying rollers and is conveyed to a target print position, and the print head ejects ink while moving perpendicular to the direction in which the print medium is conveyed. However, in the portions close to the leading or trailing end of the print medium (the leading or trailing end portion of the print medium that is conveyed using only one conveying roller because of the mechanical configuration), the leading or trailing end might be warped, depending on the print medium type. In addition, when the marginless printing mode described above is performed to eject ink onto the leading and trailing ends, the possibility is increased that warping of the print medium will become greater.

The warping of the leading or trailing end of the print medium also adversely affects the printing quality. It is known that the distance between the print head and the print medium is reduced when the print medium is warped, and that during two-way printing, performed by the print head, deviations in the landing positions of ink have occurred between the forward and the backward movements of the print head.

Therefore, a mechanism that prevents deterioration of printing quality by the warping of the leading or trailing end of a print medium is disclosed in Japanese Patent Laid-Open No. 2005-305811. This mechanism extends the head-to-sheet distance for a case wherein a possibility exists that, when the print medium is positioned, the leading end portion is not held, and thus, the print medium may be warped and contact the print head, or reduces the head-to-sheet distance for a case wherein the leading end portion is held.

Further, a mechanism employed for correcting a deviation, accompanied by a change in the head-to-sheet distance, of landing positions provided by the reciprocating movement is disclosed in Japanese Patent Laid-Open No. 2005-144808. This mechanism changes a drive signal based on the amount of displacement between the target positions of pixels that should be formed by ejecting ink from the ink ejection ports and the actual locations of pixels that were formed by ejecting ink through the ink ejection ports.

Furthermore, a mechanism that corrects discrepancies in the landing positions of ink, due to the surface condition of a sheet, is disclosed in Japanese Patent Laid-Open No. 2006-159483. To perform this correction, the mechanism employs a head-to-sheet distance sensor provided upstream of a carriage for detecting the distance between a print head and a print medium located opposite, and employs the detection signal to control the timing for the switching on of a heater employed for the ejection of ink.

According to Japanese Patent Laid-Open No. 2005-305811, for the adjustment of the head-to-sheet distance, a print head in the middle of a printing area is electrically elevated or lowered. However, merely by moving the print head up and down, ink can not be caused to land in appropriate locations, in accordance with the degree of warping at the leading or trailing end of the print medium, and black or white stripes will appear, due to a deviation in the landing position, and deterioration of the printing quality will occur.

According to Japanese Patent Laid-Open No. 2005-144808, in the process for aligning the print positions between the forward and the backward movements of the ink jet print head, the drive timing for the forward scan is fixed, and only the drive timing for the backward scan is controlled. However, in this case, since the drive timing for the forward scan is fixed, ink may be ejected onto a location shifted away from the correct landing position for the forward scan.

Also, in Japanese Patent Laid-Open No. 2006-159483, a sensor is employed to measure the distance between the print head and a print medium in real time. However, because of the mounting of the sensor, it is anticipated that the manufacturing cost will be increased.

The present invention is provided to solve the above described shortcomings. A correction process is performed for deviations in the landing positions of ink, accompanied by a change in the head-to-sheet distance at the leading end portion of a print medium, between the forward movement and the backward movement of a print head, so that printing can be performed without deterioration of the printing quality.

SUMMARY OF THE INVENTION

Therefore, one objective of the present invention is to provide an ink jet printing apparatus that can print an image without the printing quality being degraded.

An ink jet printing apparatus according to the present invention includes:

an ink jet printing apparatus comprising:

a moving unit for reciprocally moving, in a main scan direction, a print head having a nozzle array that is formed by arranging a plurality of nozzles for ejecting ink onto a print medium;

a conveying unit for conveying a print medium by employing conveying rollers that are arranged on an upstream side and a downstream side of the print head in a direction that crosses the main scan direction; and an ejection control unit for controlling ink ejection timing for ejecting ink through the nozzles, wherein, for a case of printing to be performed with the print medium sandwiched between the conveying rollers either on the upstream side or the downstream side and for a case of printing to be performed with the print medium sandwiched between the conveying rollers on both the upstream side and the downstream side, the ejection control unit differs the ink ejection timing for travel performed one way of the reciprocating movement and for travel performed the other way.

According to the present invention, the ejection control unit provided for the ink jet printing apparatus changes the ink ejection timing based on the distance from the nozzles of the print head to the print medium, and controls the ink ejection timing independently for the forward movement of the print head and for the backward movement of the print head. As a result, it is possible to provide an ink jet printing apparatus and ink jet printing method that can perform printing without reducing the printing quality.

Further features of the present invention will become apparent from the following description of exemplary embodiments (with reference to the attached drawings).

DESCRIPTION OF THE EMBODIMENTS

First Embodiment

A first embodiment of the present invention will now be described while referring to the accompanying drawings.

Figure 1:
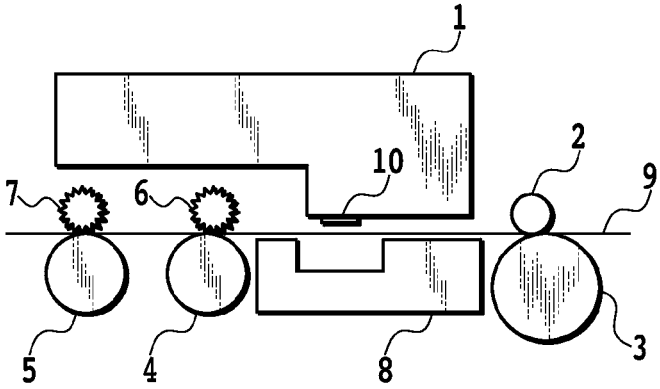
FIG. 1 is a diagram illustrating the arrangement of the printing section of an ink jet printing apparatus according to a first embodiment of the present invention.
Figure 2:
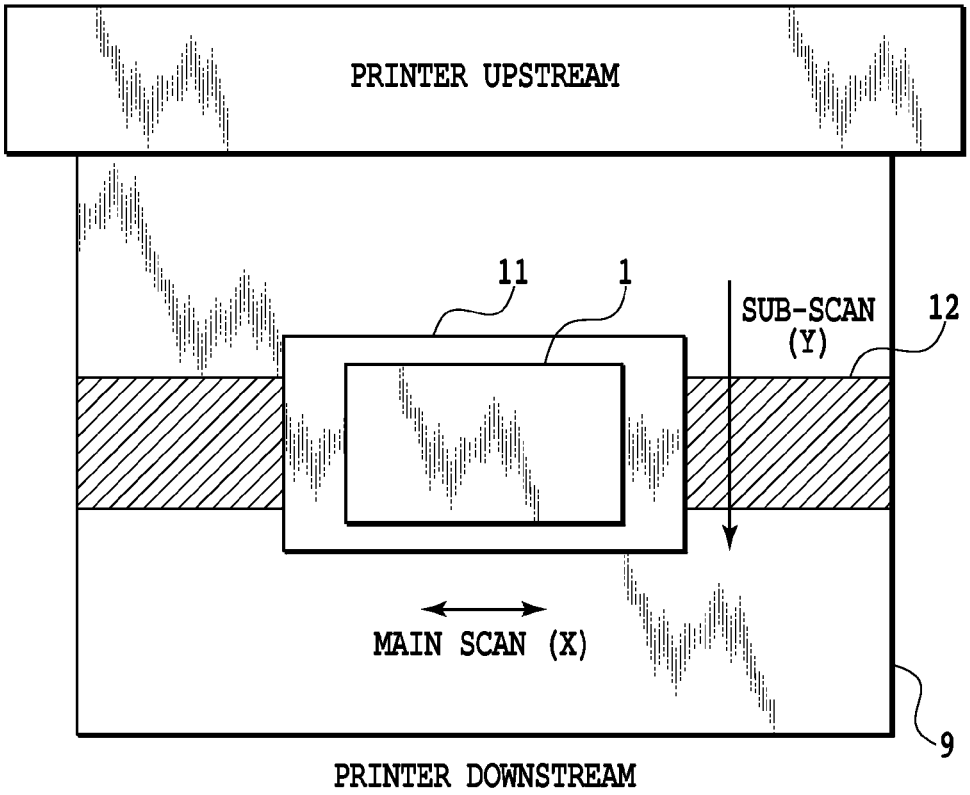
FIG. 2 is a top view of the configuration of the ink jet printing apparatus of the first embodiment.

FIG. 1 is a diagram illustrating the arrangement of the printing section of an ink jet printing apparatus (hereinafter, also called simply a printing apparatus) for this embodiment, and FIG. 2 is a top view of the configuration of the ink jet printing apparatus of this embodiment. In FIG. 1, a print head 1 includes nozzles (not shown) that are provided for the individual ejection of a variety of colored inks, and that are arranged substantially in the sub-scan direction (the direction indicated by an arrow Y).

When printing is being performed, power is selectively supplied, for predetermined periods, to heaters in ink chambers in the print head 1, heating the inks therein and generating bubbles that immediately raise the pressure in the ink chambers, which propels ink droplets through individual nozzles and onto a print medium 9. A platen 8 is positioned so as to maintain, as a reference value, a distance from the print medium 9 to the opposite print head 1, and supports the print medium 9 during printing. The reference value for the distance between the print medium 9 and the print head 1 is the maximum allowable value for the distance between the two.

When image data is transmitted by a host, such as a computer, to the printing apparatus, the print medium 9 is fed by a conveying mechanism (not shown) in the sub-scan direction (the Y direction) in FIG. 1, and is passed between a pinch roller 2 and an LF roller 3 and conveyed to the location of a printing position on the platen 8. An upstream discharge roller 4 and an upstream spur 6, and a downstream discharge roller 5 and a downstream spur 7, are also conveying rollers provided for conveying and for discharging the print medium 9 once the printing process has been completed.

In FIG. 2, when the print medium 9 has reached a predetermined location, a carriage 11, propelled by a drive motor, scans the print medium 9 along a belt in the main scan direction (direction indicated by an arrow X) to perform printing 12 for one line. And when the printing 12 for that line has been completed, the print medium 9 is conveyed in the sub-scan direction (the Y direction), and the printing of the next line is performed. Further, positioning information for the carriage 11 for the main scan direction (X direction) is obtained by reading a value held by a linear encoder positioned parallel to the carriage 11 in the main scan direction.

Figure 3A:
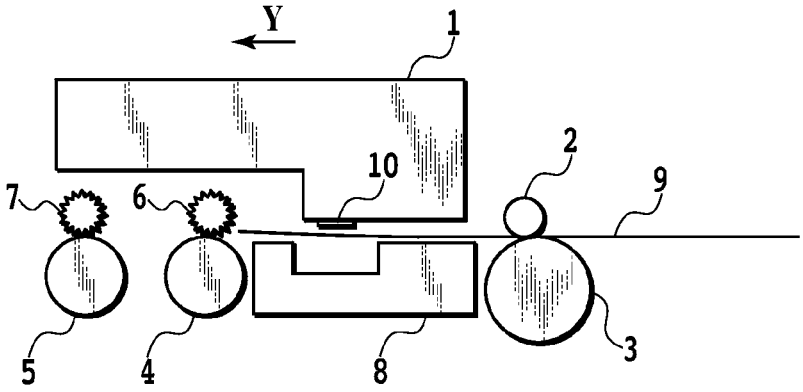
FIG. 3A is a diagram showing the state of the printing performed by the ink jet printing apparatus of the first embodiment.
Figure 3B:
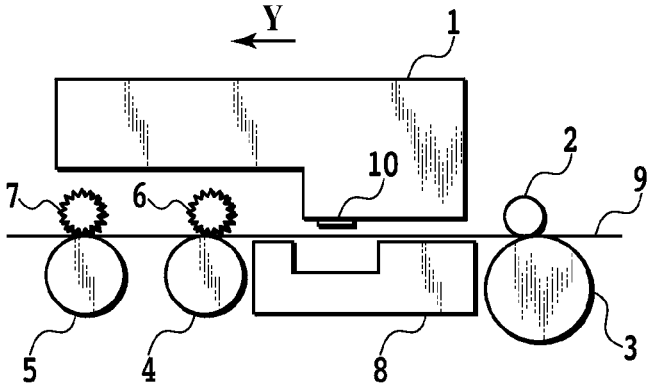
FIG. 3B is a diagram showing the state of the printing performed by the ink jet printing apparatus of the first embodiment.
Figure 3C:
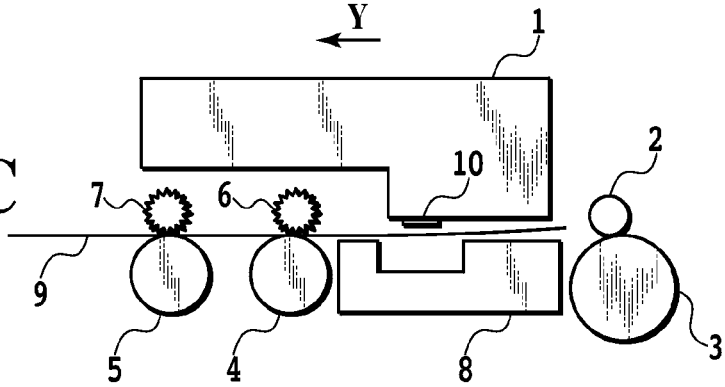
FIG. 3C is a diagram showing the state of the printing performed by the ink jet printing apparatus of the first embodiment.

FIGS. 3A to 3C are diagrams sequentially illustrating processing states during the printing performed by the ink jet printing apparatus of this embodiment. In FIG. 3A is shown the processing state of the printing apparatus after the print medium 9 leading end has entered, through a supply port, and has passed through the pinch roller 2 but the leading end has not yet reached the downstream discharge roller 5. In FIG. 3B is shown the processing state after the leading end of the print medium 9 has passed the downstream discharge roller 5 but the trailing end has not yet passed the pinch roller 2. And in FIG. 3C is shown the processing state after the trailing end of the print medium 9 has passed the pinch roller 2 but and the trailing end has not yet reached the upstream discharge roller 6.

Figure 4:
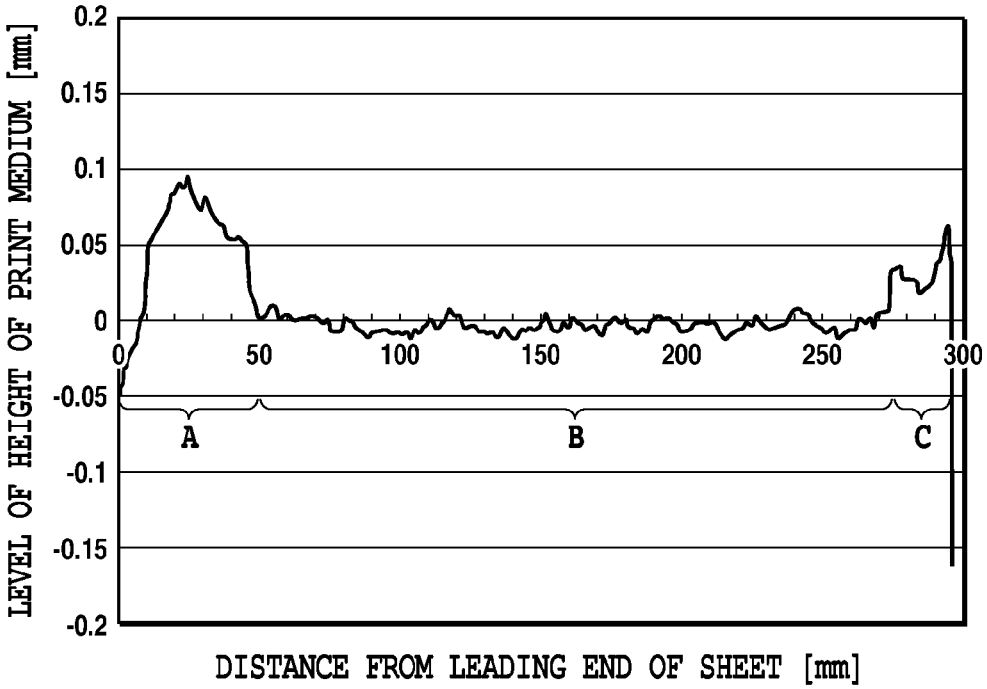
FIG. 4 is a graph showing a head-to-sheet distance change obtained using a laser distance measuring device.

FIG. 4 is a graph showing a head-to-sheet distance change obtained using a laser distance measuring device. In this case, the distance measuring device, located atop the printing apparatus, emitted a laser that impinged on a print medium and received scattered rays reflected by the print medium. In this manner, changes in a head-to-sheet distance could be measured (detected). Before the leading end of the print medium reached the spurs, or after the leading end has passed the spurs but before the trailing end reaches them, a conveying roller is provided only on one side both for a sheet supply section and for a sheet discharge section.

Therefore, the print medium 9 pressed against the platen 8 is warped, and this causes the print medium 9 to be positioned nearer the print head 1. As a result, it has been found that the period required from the time ink is ejected from the print head 1 until that ink reaches the print medium 9 is changed, between the state in FIG. 3A and the state in FIG. 3C, and a deviation in the landing position occurs between the forward movement and the backward movement in the main scan direction. Therefore, in this embodiment, first, in the state shown in FIG. 3B, which is a stable state wherein there is no head-to-sheet distance change, an adjustment in the landing position is performed between the forward movement and the backward movement. Then, landing positions are corrected in the states shown in FIG. 3A and in FIG. 3C to remove the deviation in the landing positions caused by the head-to-sheet distance change.

Figures 5A, 5B, 5C:
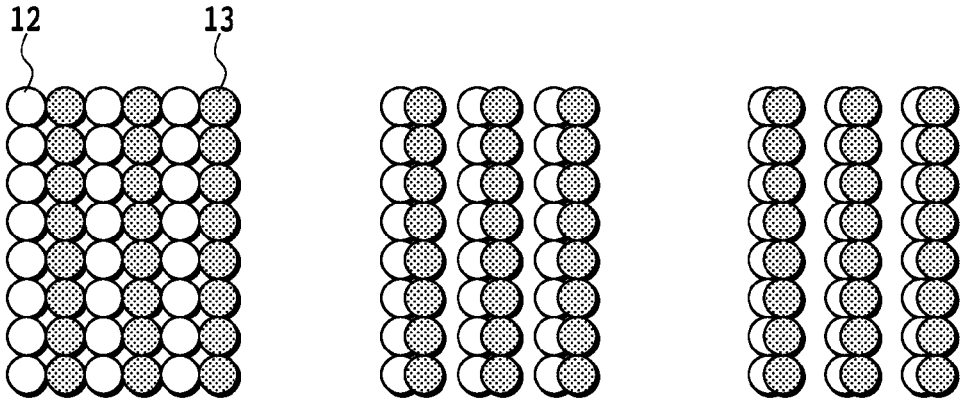
FIG. 5A is a diagram showing an example printed pattern.
FIG. 5B is a diagram showing another example printed pattern.
FIG. 5C is a diagram showing an additional example printed pattern.

FIGS. 5A to 5C are diagrams showing example printing patterns for aligning printing positions between the forward movement and the backward movement of the print head 1. In these examples, the print head 1 ejects ink during a reciprocating movement, and forms ink dots (hereinafter also referred to as dots) on a print medium. In this embodiment, the ink jet printing apparatus performs so-called multi-path printing, as illustrated, that performs forward printing and backward printing in the same printing area of a print medium.

In FIGS. 5A to 5C, solid white dots 12 represent dots formed on a print medium 9 by the forward scanning (forward movement) of the print head 1, and hatched dots 13 represent dots formed by the backward scanning (backward movement). In these examples, for the sake of convenience, these dots are distinguished by being hatched or not; however, since in this embodiment the dots are formed by ejecting ink through the same print head 1, and do not correspond to either the colors of the dots, or the densities of the colors.

The printing pattern in FIG. 5A represents a state wherein dots were printed while their printing positions were aligned; the pattern in FIG. 5B represents a state wherein dots were printed after their printing positions had been shifted slightly; and the pattern in FIG. 5C represents a state wherein dots were printed after their printing positions had been shifted further. The purpose of these patterns is to illustrate a reduction in an area factor (the ratio of a printed area of a print medium relative to a predetermined area of the print medium) upon the occurrence of a printing position displacement between the forward and backward movements.

This is important because printing density depends greatly on a change in the area factor. This occurs when the printing density is increased by the overlapping of ink dots; however, an increase in the size of a non-printing area has a greater influence on the density average of a printed portion. Thus, the above described method is employed to obtain an optimal landing position for an area wherein a head-to-sheet distance change does not occur.

Figure 6:
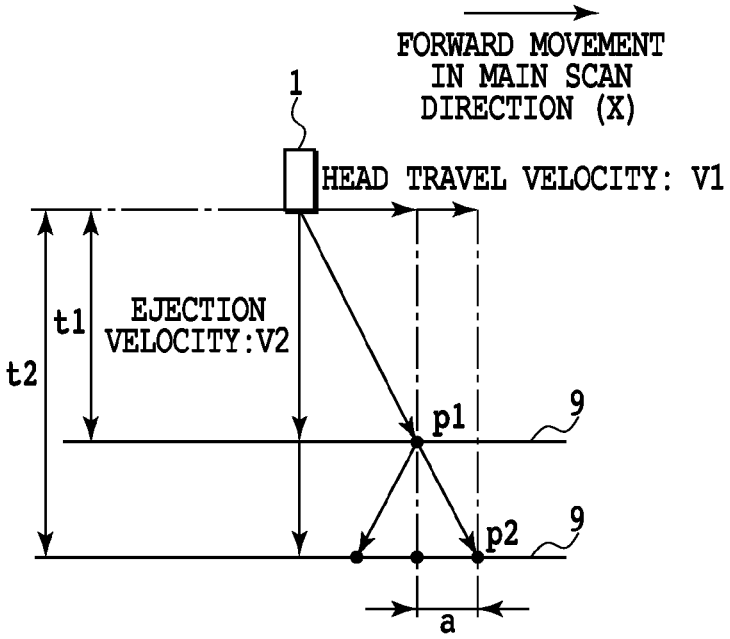
FIG. 6 is a diagram for explaining a deviation in landing positions due to a head-to-sheet distance change that is accompanied by the forward movement of a print head.

FIG. 6 is a diagram for explaining a deviation in a landing position due to a head-to-sheet distance change that is accompanied by the forward movement of the print head 1. When the ink jet printing apparatus for this embodiment performs the printing operation, the print head 1 ejects ink onto the print medium 9, while moving forward and backward in the main scan direction (direction indicated by an arrow X). At this time, an appropriate value should be set for the distance from the print head 1 to the surface of the print medium 9, so that during printing, the print head 1 does not contact the print medium 9.

However, as described above, it has been found that because of the mechanical configuration, the leading end or the trailing end portion of the print medium 9 has to be conveyed using only one conveying roller, and therefore, the print medium 9 is pressed against the platen 8 and warped. Referring now to FIG. 6 for a printing operation wherein a landing position p1 was originally obtained for a print medium 9 having a head-to-sheet distance of t1, but when ink droplets were to be ejected, the print medium condition was such that the head-to-sheet distance t1 had changed to t2, due to a head-to-sheet distance change for the leading or trailing end portion of the print medium 9, and a new landing position p2 was obtained.

As a result, a deviation a is present between the position p1 and the position p2. That is, the position p1, the initial, expected landing position, can not be obtained because of a variance in the head-to-sheet distance, and an appropriate image can not be formed.

In this embodiment, therefore, a deviation in a landing position is calculated using an estimated head-to-sheet distance change, and based on the deviation, ink ejection timings can be adjusted during the printing operation and ink droplets can be accurately deposited at expected landing positions. The deviation a can be calculated using the travel velocity of the print head 1 and the ink droplet ejection velocity at the print head 1, and a head-to-sheet distance between the surface of the print medium 9 and the print head 1. When V1 denotes the travel velocity of the print head 1, V2 denotes the ink ejection velocity at the print head 1, and t1 and t2 denote, in turn, the head-to-sheet distance between the print medium 9 and the print head 1 before and after the head-to-sheet distance change occurred, the deviation a can be represented as $$a=V1(t2-t1)/V2.$$

Figure 7:
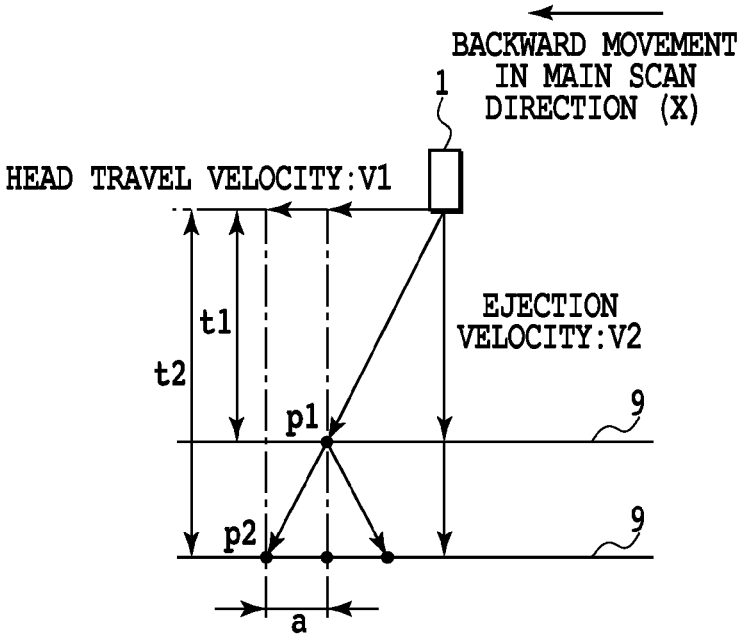
FIG. 7 is a diagram for explaining a deviation in landing positions due to a head-to-sheet distance change that is accompanied by the backward movement of a print head.

FIG. 7 is a diagram for explaining a landing position deviation due to a head-to-sheet distance change accompanied by the backward movement of the print head 1. As well as in the state depicted in FIG. 6 for the forward movement, showing the occurrence of a landing position deviation, basically a deviation a for the landing positions also occurs during the backward movement. It should be noted that since the moving directions of the print head 1 are opposite each other, the directions in which the deviation a has occurred are also opposite for the forward movement and the backward movement.

That is, a deviation a in the forward direction occurs due to the forward movement of the print head 1, and a deviation a in the backward direction occurs due to the backward movement. Furthermore, the print head 1 moves at the same velocity in the forward direction and in the backward direction, and in either case, almost the same amount of the deviation a occurs.

Figure 8A:
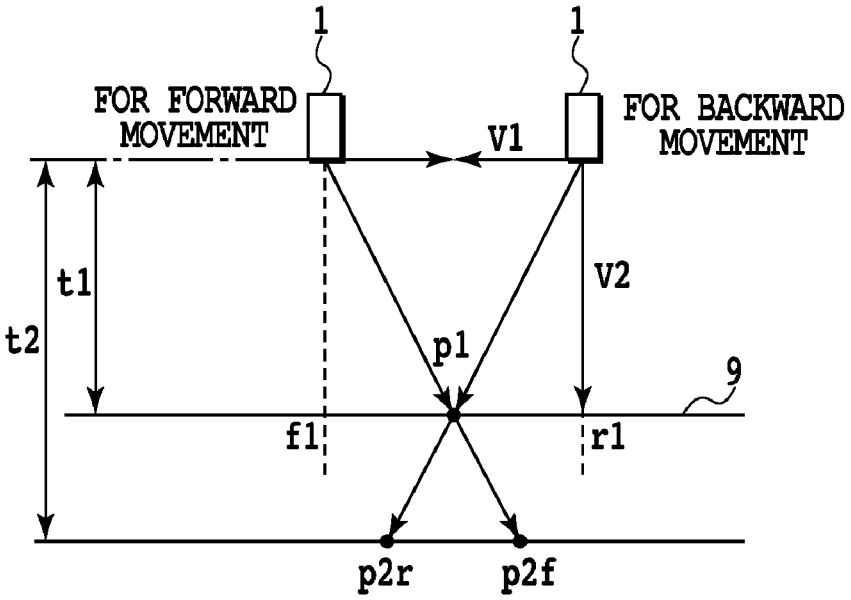
FIG. 8A is a diagram for explaining a process for the alignment of landing positions for ink.
Figure 8B:
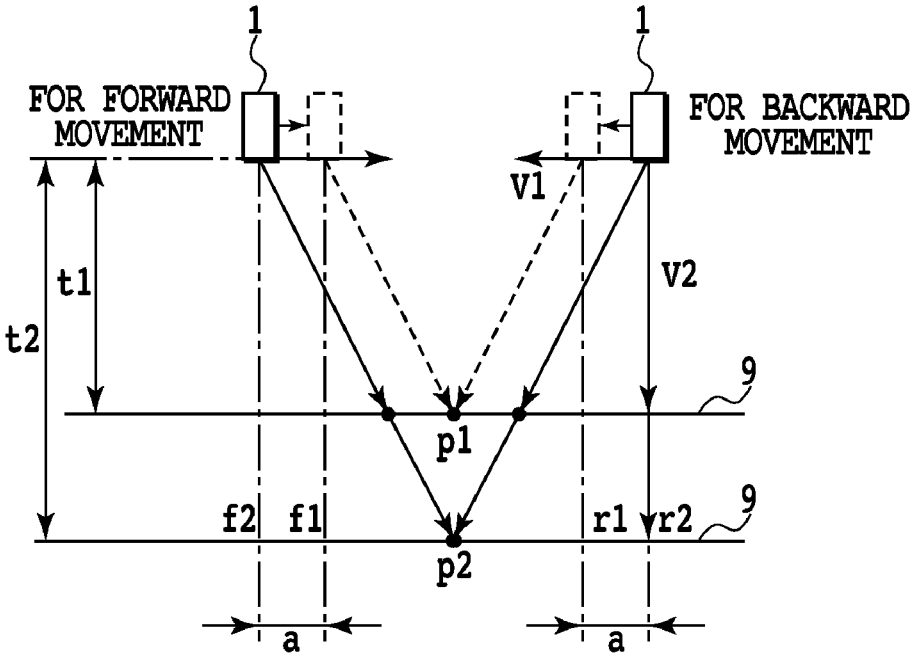
FIG. 8B is a diagram for explaining the process for the alignment of landing positions for ink.

FIGS. 8A and 8B are diagrams for explaining a method employed by the ink jet printing apparatus of this embodiment for aligning ink landing positions. In this embodiment, based on the deviation obtained in the above described manner, correction for the ink ejection timing is performed independently for the forward scanning and for the backward scanning.

Specifically, for the case shown in FIG. 8A, wherein t1 is a distance between the print head 1 and the surface of the print medium 9 and p1 is an expected landing position on the surface of the print medium 9, during the forward movement of the print head 1, the ejection of ink is performed at a position f1, which is before the landing position p1 in the forward direction, and during the backward movement, the ejection of ink is performed at a position r1, which is before the landing position p1 in the backward direction. In this manner, the landing positions obtained by the forward movement and the backward movement can be aligned with the landing position p1.

Furthermore, consider a case wherein the distance t1, between the surface of the print medium 9 and the print head 1, is changed to t2. Referring to FIG. 8A, when ink is ejected onto the print medium 9 using the same drive timing as is used for the head-to-sheet distance t1, during the forward movement ink is deposited at a landing position 2*pf*, which is farther from p1 in the forward direction, and during the backward movement ink is deposited at a landing position p2*r*, which is farther from p1 in the backward movement. As a result, it is found that the landing positions provided by the forward movement and the backward movement deviate.

Therefore, ink is ejected at the drive timings shown in FIG. 8B. That is, during the forward movement ink is ejected at a position f2, which is before the position f1 in the forward direction, and during the backward movement, ink is ejected at a position r2, which is before the position r1 in the backward direction. At this time, positions f2 and r2 are located before the positions r1 and f1 by a distance equivalent to the deviation a.

When the head-to-sheet distance is changed, the drive timing need only be adjusted in the above described manner, and the landing positions for the forward movement and the backward movement can be aligned with the positions before the head-to-sheet distance was changed. A correction value E used for controlling the drive timing can be calculated as follows. When a drive timing unit is Dpdi, a correction value E, used to correct the deviation a of landing positions, is obtained as $$E=a/D.$$

In this embodiment, the ink ejection timing is controlled based on the thickness of a print medium (distance from the nozzles of a print head to a print medium) and the traveling velocity of the print head. Thus, for a case wherein the distance from the surface of the print medium to the print head fluctuates between t1 and t2, a deviation in the landing positions in the main scan direction can be corrected, and ink can be ejected onto the expected landing position p1 or p2.

Figure 9:
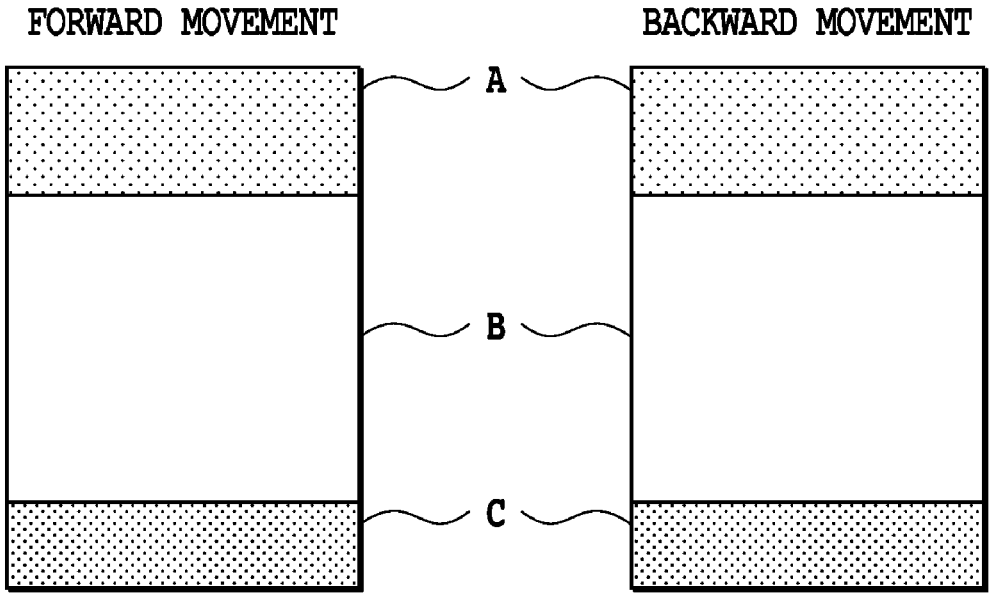
FIG. 9 is a diagram showing areas of a print medium for which a correction value E differs.

FIG. 9 is a diagram showing the areas of the print medium 9 for which a correction value E differs. These areas are an area A, where the head-to-sheet distance changes, an area B, where the head-to-sheet distance does not change, and an area C, where the head-to-sheet distance changes in a different way. The locations of the areas A, B and C are the same for the forward movement and the backward movement of the print head 1. In this embodiment, as a correction value E for the drive timing for the individual states, the same absolute value is entered for the forward movement and the backward movement. Actually, however, due to a mechanical allowance, there are differences in the head-to-sheet distance and in the main scanning velocity during the reciprocating movement of the print head 1.

In a case wherein different absolute correction values are required for the forward movement and for the backward movement, such correction values can be individually provided for the forward and backward movements. Furthermore, when the ejection velocity and the dot diameter differ, depending on the structure of a print head and the type of ink, these entries can be designated separately. Through this process, the correction E, with which the ejection of ink onto the expected landing position can be appropriately performed, can be obtained while coping with the head-to-sheet distance change.

Figure 10:
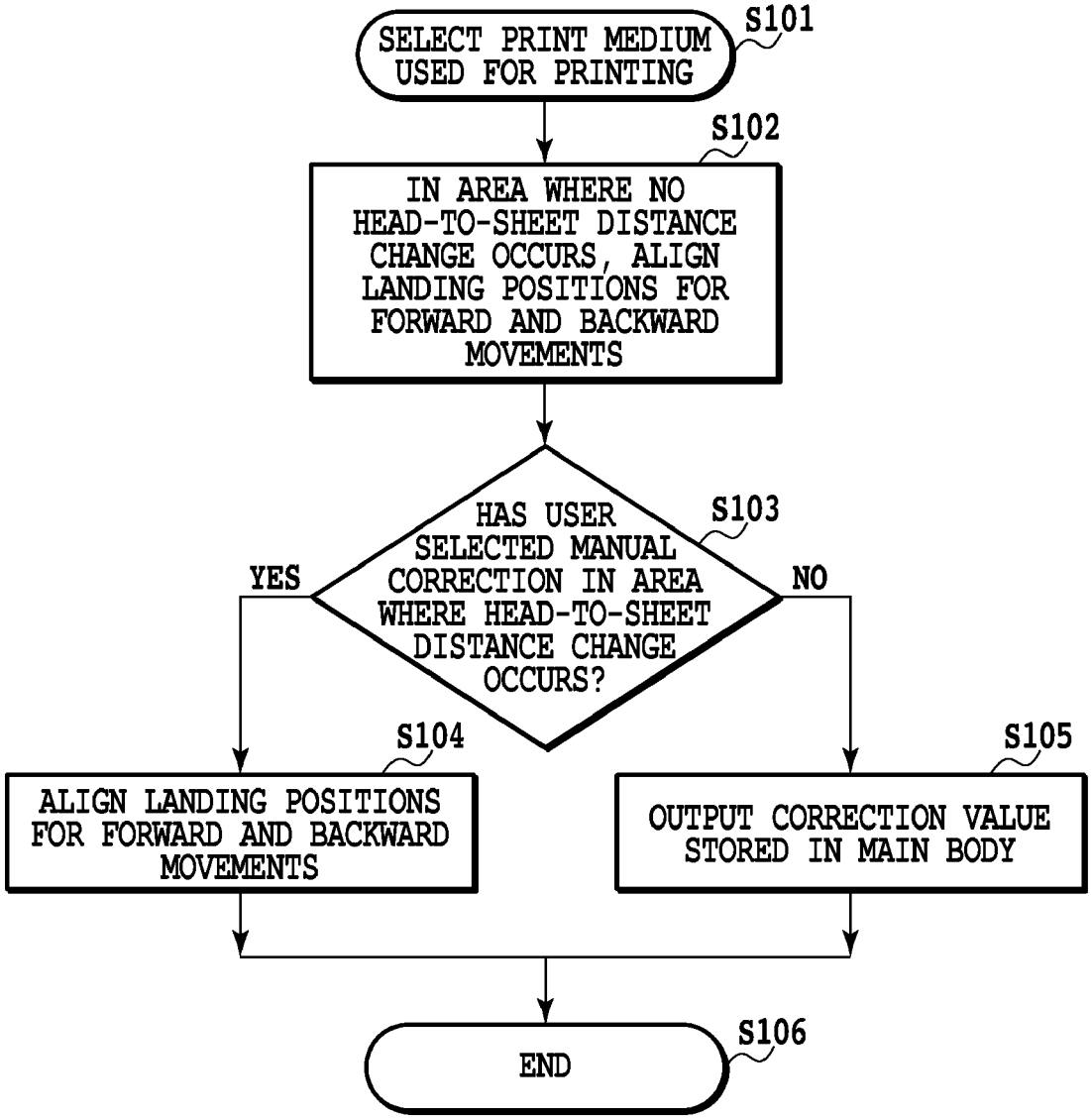
FIG. 10 is a flowchart showing the correction processing performed for the first embodiment.

FIG. 10 is a flowchart showing the correction operation performed in this embodiment. The individual steps of this processing will now be described using the flowchart. The head-to-sheet distance changes at the leading and trailing end portions, and the magnitude of these changes varies, depending on the type and size of a print medium. Thus, at the beginning of printing, at step S101 the type and size of a print medium to be employed are selected, and at step S102, landing positions for the forward movement and the backward movement are aligned in the area B, wherein the head-to-sheet distance does not change.

At step S103, a user designates whether he or she will manually align landing positions for the forward movement and the backward movement in the areas A and C, wherein the head-to-sheet distance fluctuates. When the user selects to perform manual alignment, program control advances to step S104, where the user manually aligns the landing positions for the forward movement and the backward movement in the areas A and C. When at step S103 the user does not select to perform manual alignment, program control advances to step S105, and a fixed value, which is stored in advance in the storage unit of the main body, is output as a correction value for a drive timing.

As described above, based on the type of print medium, areas related to the head-to-sheet distance change and the drive timings that are individually provided for the forward and the backward movements, either the correction value in the storage unit is output, or the landing positions in the individual areas are manually aligned. As a result, when the head-to-sheet distance in each state is changed, landing position deviations, which is caused by the head-to-sheet distance changes, can be corrected for the forward and the backward movements.

The drive timing in this embodiment may be changed in accordance with the amount of ink ejected or the color of the ink. As described above, corrections for the head-to-sheet distance changes have been performed for the forward printing and the backward printing in multi-path printing. As a result, an ink jet printing apparatus can be provided that can perform printing without degrading the printing quality.

Second Embodiment

A second embodiment of the present invention will now be described while referring to drawings. Since the configuration of this embodiment is basically the same as that of the first embodiment, only the characteristic arrangement provided for this embodiment will be described.

Figure 11:
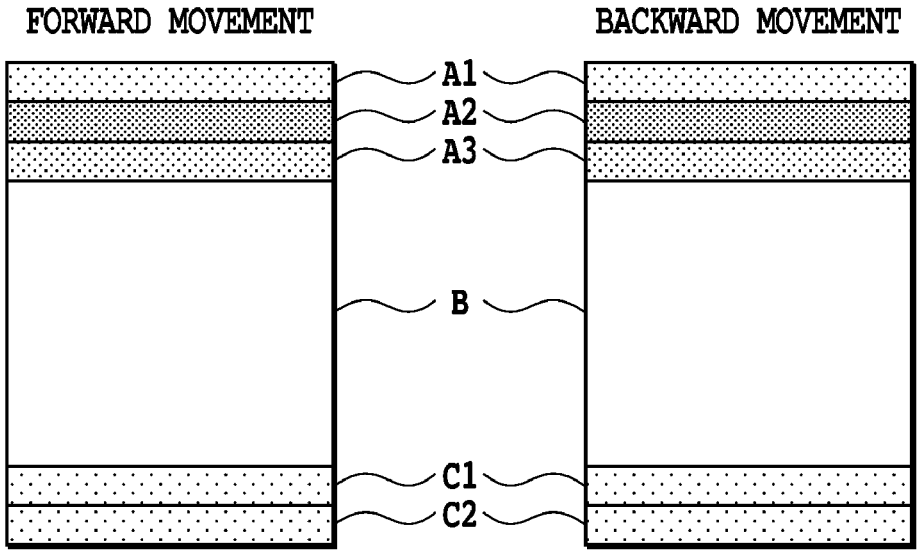
FIG. 11 is a diagram showing areas of a print medium, according to a second embodiment of the present invention, for which a correction value E differs.

FIG. 11 is a diagram for this embodiment showing the areas of a print medium for which a correction value E differs. In this embodiment, the area A shown in FIG. 9 for the first embodiment is divided into three areas, A1, A2 and A3, to provide different correction values E. Further, the area C shown in FIG. 9 for the first embodiment is also divided into two areas, C1 and C2, to provide different correction values E.

As a result, since a drive timing adjustment is performed when the warping of the leading or trailing end portion of a print medium causes the print medium to approach a print head, even a smaller change in a head-to-sheet distance can be corrected, and the landing positions for the forward movement and the backward movement can be aligned.

As described above, a correction for a head-to-sheet distance change is performed for forward printing and backward printing during a multi-path printing operation. And as a result, an ink jet printing apparatus can be provided that can perform printing without degrading the printing quality.

Third Embodiment

A third embodiment of the present invention will now be described while referring to drawings. Since the configuration of this embodiment is basically the same as that of the first embodiment, only the characteristic arrangement provided for this embodiment will be described.

Figure 12:
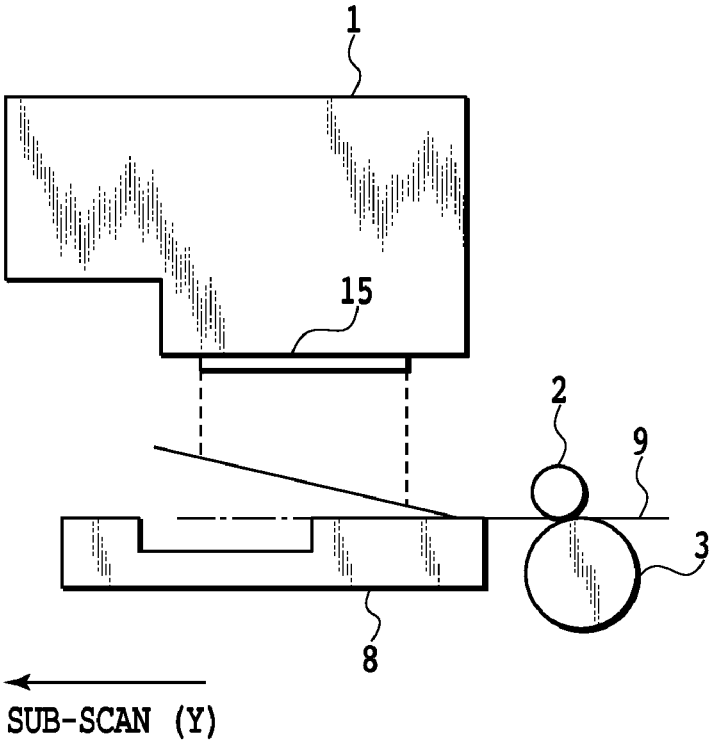
FIG. 12 is a diagram illustrating one part of an ink jet printing apparatus for which a third embodiment of the present invention can be applied.

FIG. 12 is a diagram showing part of a printing apparatus for which the third embodiment can be applied. In this embodiment, an elongated array of print elements included in a print head 1 is employed, and a head-to-sheet distance is focused on in a state A between a print medium 9 and the tip of the elongated array. According to the first embodiment, it has been assumed that the length from the top end print element and the bottom end print element of a print element array is small, and that there is no change in the head-to-sheet distance in one print element array.

However, inevitably, the length of a print element array will be elongated in consonance with a current increase in the printing speed, and after the printing of merely one line has been completed, a deviation due to a head-to-sheet distance change, between landing positions provided by one end of a print element array and the other end, can not be ignored. This will be explained using FIGS. 3A and 3C.

In FIG. 3A, when a print medium 9 is conveyed in a direction indicated by an arrow Y and is passed through a pinch roller 2, the end of the print medium 9 is warped, and the amount of warp is greater on the downstream side of the print element array than on the upstream side. In FIG. 3C, the print medium 9 is conveyed using only an upstream discharge roller 4 and an upstream spur 6, and a downstream discharge roller 5 and a downstream spur 7.

Therefore, the trailing end of the print medium 9 is warped, and contrary to the case for the leading end of the print medium 9, the amount of warp is greater on the upstream side of the print element array than on the downstream side.

Furthermore, when the print element array is elongated, inclination of the print head 1, i.e., inclination of the print element array, will greatly influence the printing process. That is, if the print head 1 is mounted with inclination, the landing positions for ejected ink would be shifted greatly relative to the original landing positions.

Therefore, in this embodiment, both the inclination of the print head and the warping of the print medium are corrected to provide high quality printing. The method employed for these corrections will now be described.

Figure 13A:
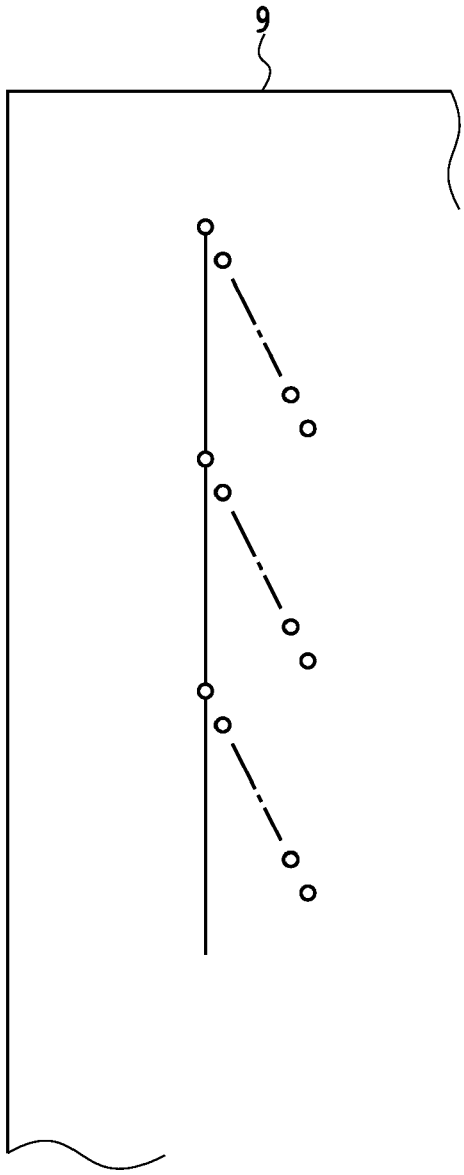
FIG. 13A is a diagram showing an example print medium for which printing has been performed.
Figure 13B:
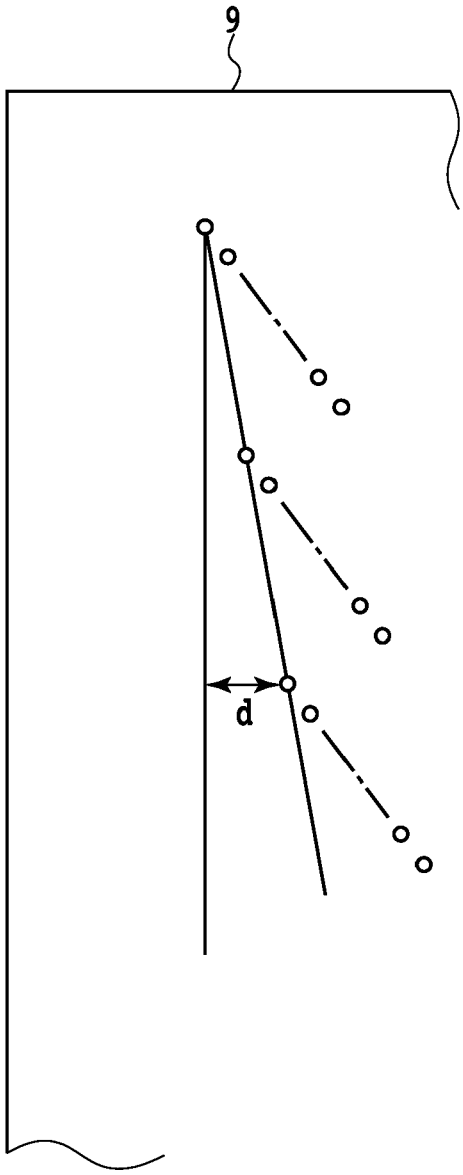
FIG. 13B is a diagram showing another example print medium for which printing has been performed.

FIGS. 13A and 13B are diagrams showing a print medium 9 after printing has been completed. In FIG. 13A, printing was performed in a state wherein the print head 1 was correctly mounted, with no inclination, and in FIG. 13B, printing was performed in a state wherein the print head 1 was inclined in the main scan direction. Referring to FIG. 13A, since the print head 1 is correctly positioned, ejected ink is deposited at the correct positions. On the other hand, referring to FIG. 13B, since the print head 1 is inclined, a deviation d has appeared in the printing results.

Assume that V1 is the travel velocity of the print head 1, V2 is the ink droplet ejection velocity at the print head 1, t1*u* is a head-to-sheet distance from the print medium 9 to the upstream side of the print element array in the print head 1, and t1*d* is a head-to-sheet distance from the print medium 9 to the downstream side of the print element array in the print head 1. Further, assuming that the print medium 9 is warped at a predetermined angle, the deviation d of the landing positions in the main scan direction (X), which is caused by the head-to-sheet distance change, can be represented by $$d=V1(t1d-t1u)/V2.$$

Figure 14:
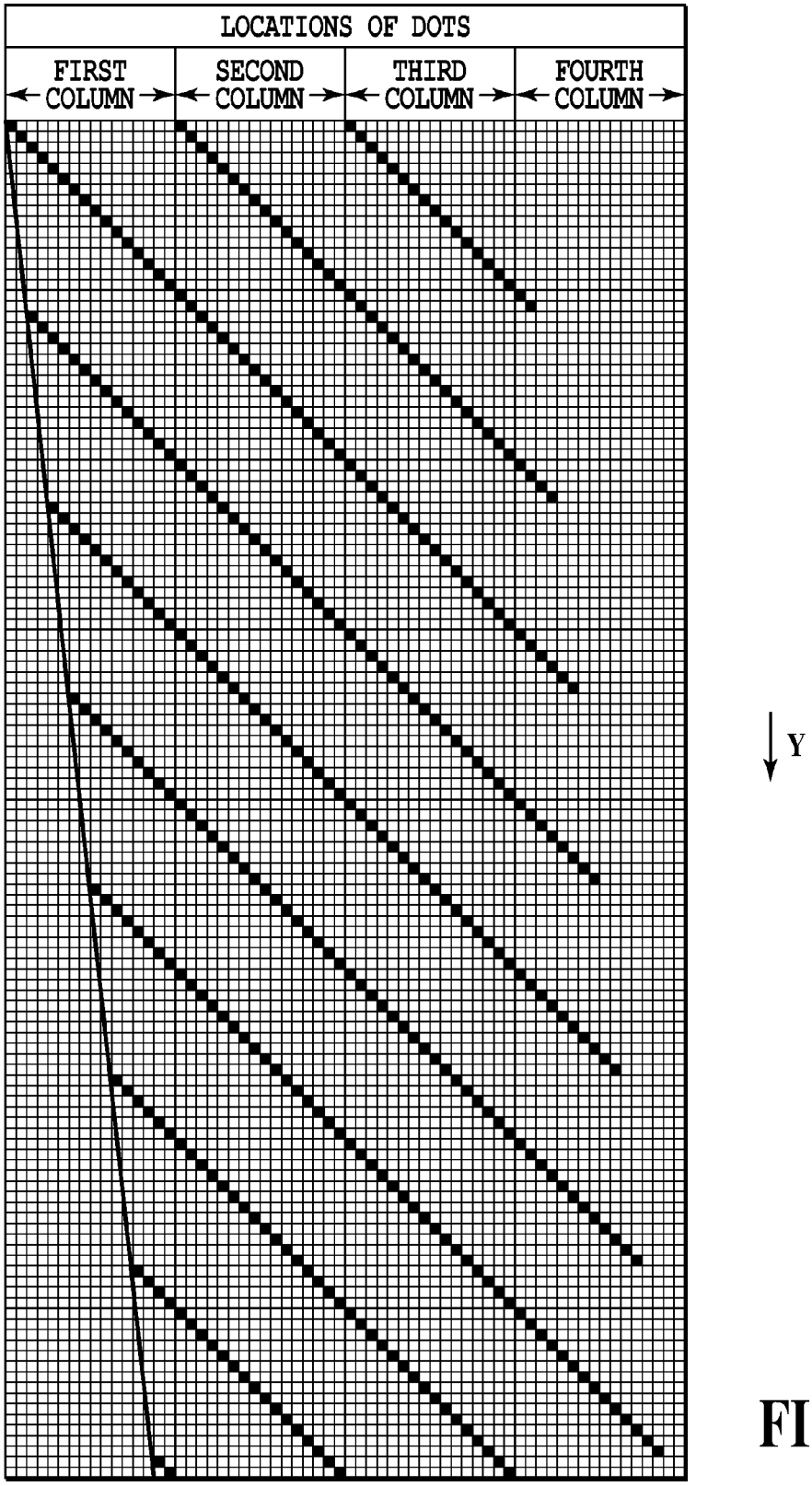
FIG. 14 is a diagram showing the printing results obtained using an inclined print head.
Figures 15, 15A:
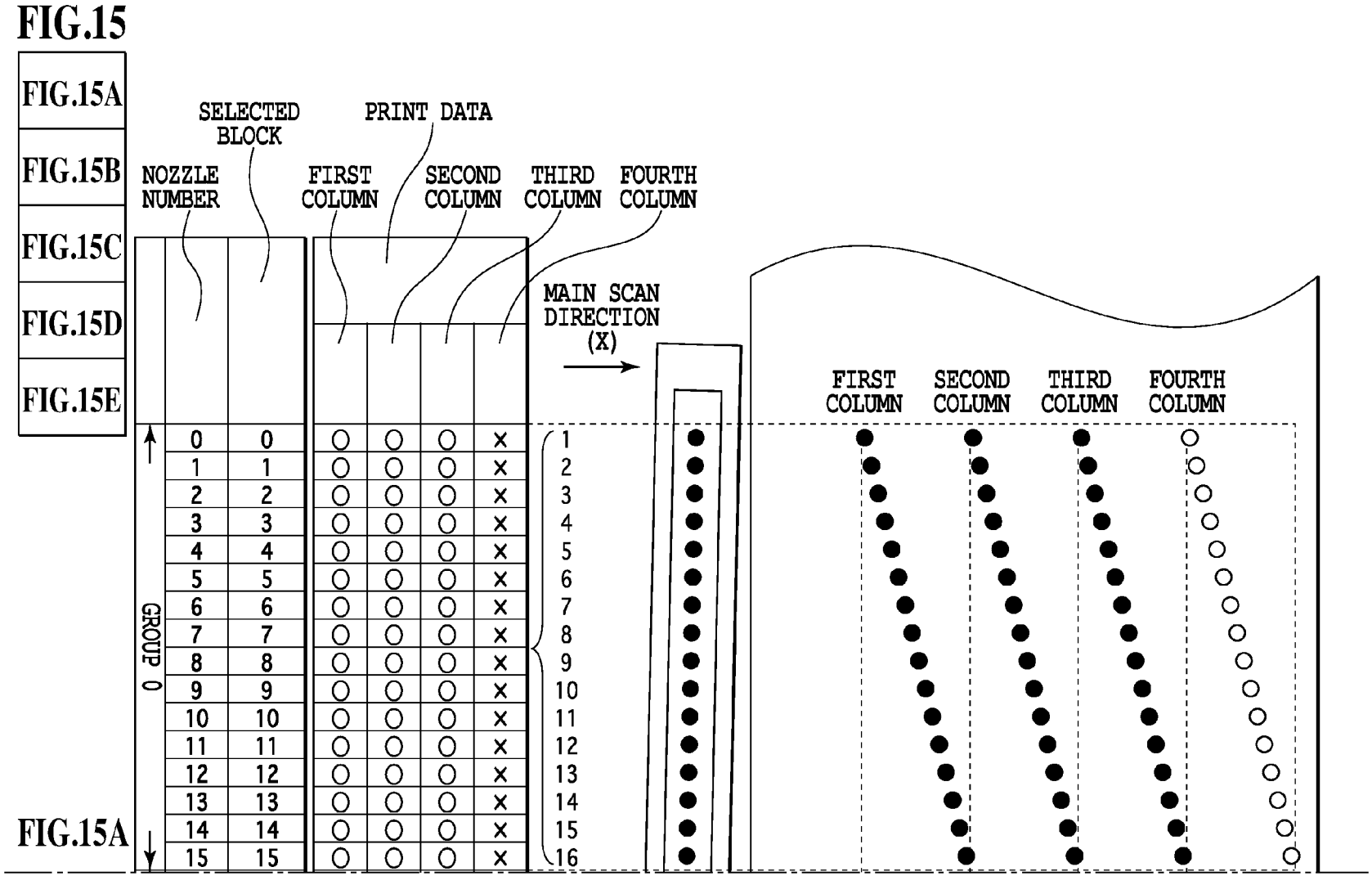
FIG. 15 is a diagram showing the relationship of FIG. 15A to FIG. 15E.
FIG. 15A is a diagram for explaining a method for correcting the misalignment of ink deposited by a print head.
Figure 15B:
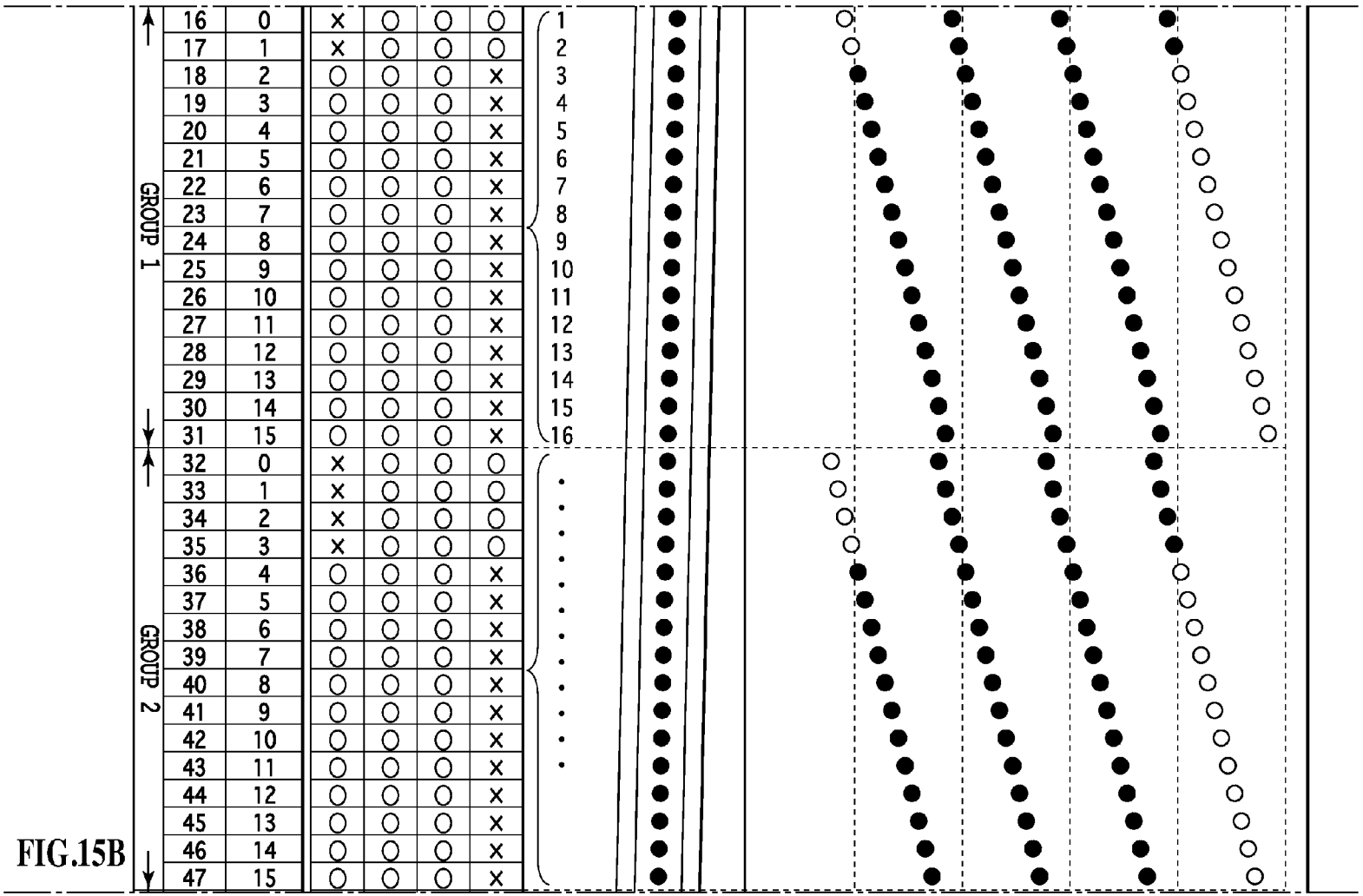
FIG. 15B is a diagram for explaining a method for correcting the misalignment of ink deposited by a print head.
Figure 15C:
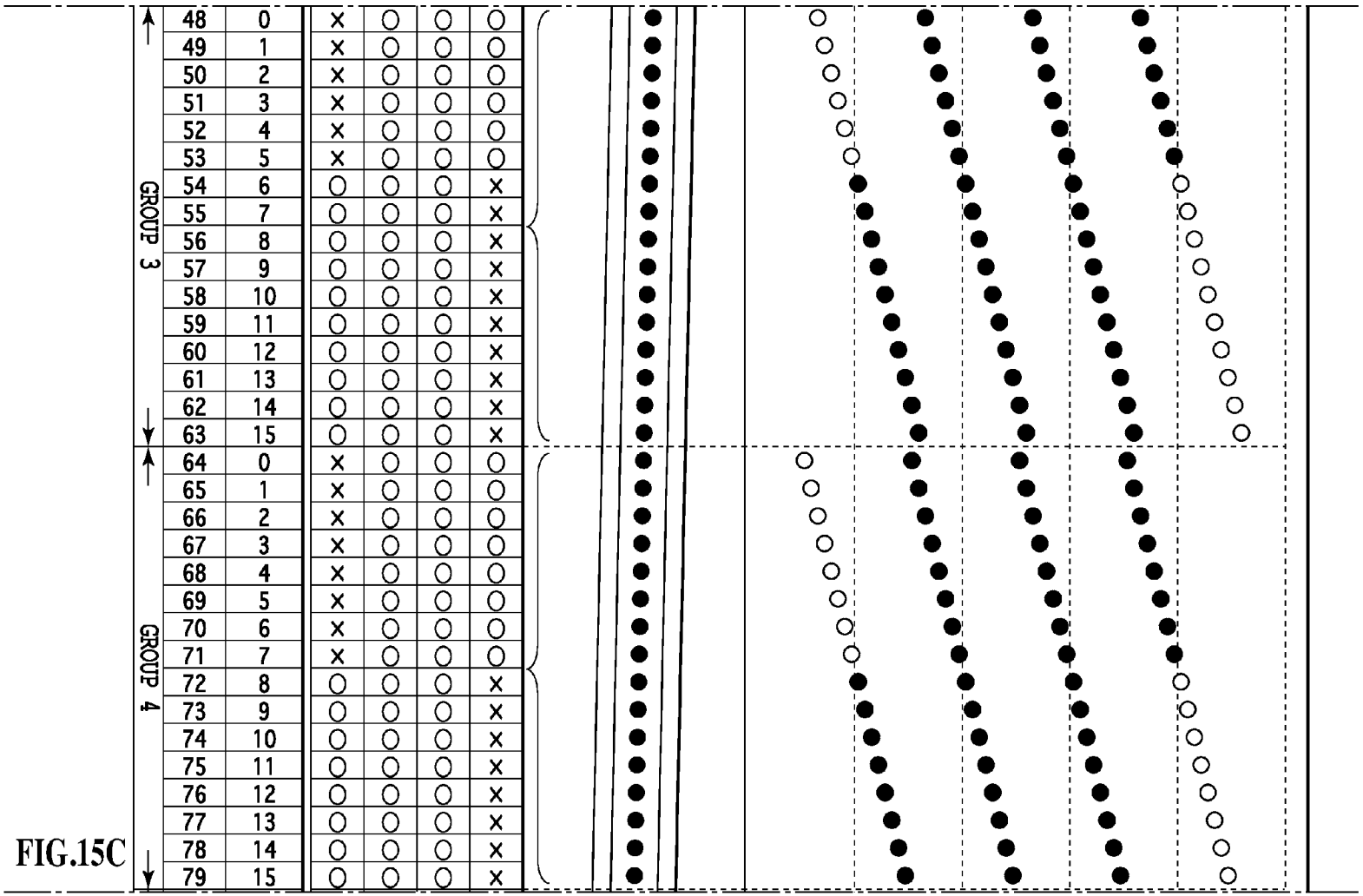
FIG. 15C is a diagram for explaining a method for correcting the misalignment of ink deposited by a print head.
Figure 15D:
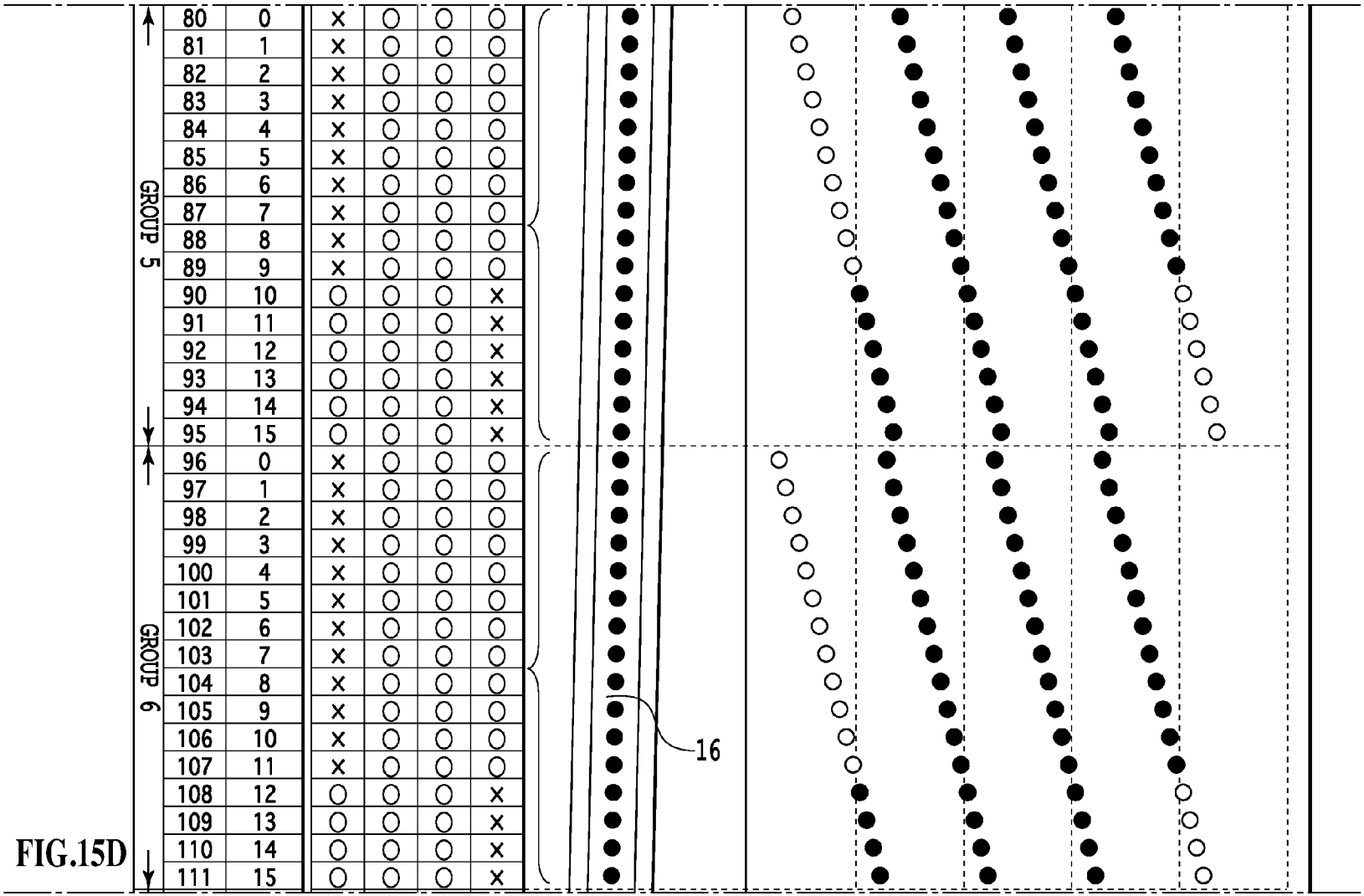
FIG. 15D is a diagram for explaining a method for correcting the misalignment of ink deposited by a print head.
Figure 15E:
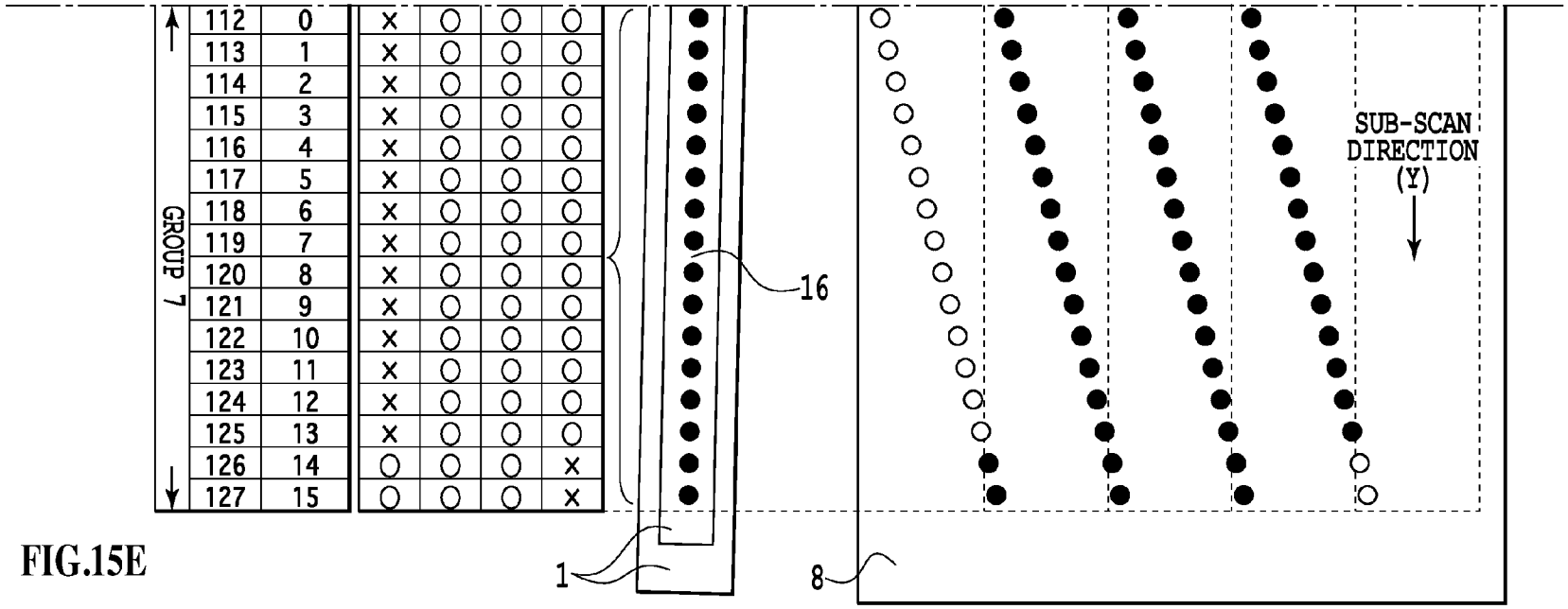
FIG. 15E is a diagram for explaining a method for correcting the misalignment of ink deposited by a print head.

A technique for correcting the deviation d of landing positions is proposed in Japanese Patent Laid-Open No. 2009-006676, and an overview of the technique will be described below. FIG. 14 is an enlarged diagram showing the results obtained by printing when the print head 1 is mounted with inclination, i.e., showing the results obtained by printing straight lines that are parallel to the direction in which a print medium is conveyed (direction indicated by an arrow Y). Since in this case the print head 1 is inclined, however, the printed lines are inclined instead of being parallel to the direction in which the print medium is conveyed (direction indicated by the arrow Y).

FIG. 15A to FIG. 15E are a diagram for explaining the method disclosed in Japanese Patent Laid-Open No. 2009-006676, for correcting the shifting of the print head. According to Japanese Patent Laid-Open No. 2009-006676, the nozzle array of the print head is divided into a plurality of blocks, and the ejection of ink is controlled for individual blocks to correct for the inclination of the print head.

In this embodiment, the method disclosed in Japanese Patent Laid-Open No. 2009-006676 is employed to correct for both the inclination of the print head and the warping of a print medium. That is, when there is warping of a print medium and a nozzle array to be used is elongated, the distance from the print medium to the upstream nozzle of a nozzle array in the print medium conveying direction (direction indicated by the arrow Y) and the distance from the print medium to the downstream nozzle in the print medium conveying direction differ greatly.

Therefore, using the method described in Japanese Patent Laid-Open No. 2009-006676, the nozzle array is divided into a plurality of blocks, and the correction of drive timing is performed for the individual blocks, as explained in the first embodiment of the present invention. As a result, corrections can be applied for the inclination of the print head, which employs an elongated nozzle array, and the warping of the print medium.

In this embodiment, the nozzle array has been divided into a plurality of blocks, and the drive timing has been corrected for individual blocks. However, the unit for the correction of drive timing is not limited to a block, and correction of the drive timing may be performed for each nozzle.

As described above, a correction for the head-to-sheet distance change is performed for the forward printing and backward printing in multi-path printing. As a result, an ink jet printing apparatus can be provided that performs printing without degrading the printing quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-088654, filed Apr. 7, 2010, which is hereby incorporated by reference herein in its entirety.

What is claimed is:

1. An ink jet printing apparatus comprising:

a moving unit for reciprocally moving, in a main scan direction, a print head having a nozzle array that is formed by arranging a plurality of nozzles for ejecting ink onto a print medium;

a conveying unit for conveying a print medium by employing conveying rollers that are arranged on an upstream side and a downstream side of the print head in a direction that crosses the main scan direction; and an ejection control unit for controlling ink ejection timing for ejecting ink through the nozzles, wherein, for a case of printing to be performed with the print medium sandwiched between the conveying rollers either on the upstream side or the downstream side and for a case of printing to be performed with the print medium sandwiched between the conveying rollers on both the upstream side and the downstream side, the ejection control unit differs the ink ejection timing for travel performed one way of the reciprocating movement and for travel performed the other way.

2. The ink jet printing apparatus according to claim 1, wherein the nozzles of the nozzle array are divided into a plurality of blocks, and for each of the blocks, the ejection control unit controls the ink ejection timing.

3. The ink jet printing apparatus according to claim 1, wherein based on an amount of ink to be ejected through the nozzles, the ejection control unit controls the ink ejection timing.

4. The ink jet printing apparatus according to claim 1, wherein, based on which color of ink is to be ejected through the nozzles, the ejection control unit controls the ink ejection timing.

5. An ink jet printing method comprising the steps of:

reciprocally moving, in a main scan direction, a print head having a nozzle array that is formed by arranging a plurality of nozzles for ejecting ink onto a print medium;

conveying a print medium by employing conveying rollers that are arranged on an upstream side and a downstream side of the print head in a direction that crosses the main scan direction; and controlling ink ejection timing for ejecting ink through the nozzles during the reciprocating movement of the print head, wherein, for a case of printing to be performed with the print medium sandwiched between the conveying rollers either on the upstream side or the downstream side and for a case of printing to be performed with the print medium sandwiched between the conveying rollers on both the upstream side and the downstream side, the ink ejection timing differs for travel performed one way of the reciprocating movement and for travel performed the other way.

* * * * *